US006519440B2

(12) United States Patent
Kimura et al.

(10) Patent No.: US 6,519,440 B2
(45) Date of Patent: Feb. 11, 2003

(54) OIL APPLICATION DEVICE HAVING OIL APPLICATION AMOUNT CONTROL LAYER BONDED TO OIL RETAINING MEMBER FOR RETAINING APPLICATION-USE SILICONE OIL USING MIXTURE OF ADHESIVE AND MIXTURE-USE SILICONE OIL

(75) Inventors: Kohichi Kimura, Hamamatsu (JP); Tatsuo Takagi, Hamamatsu (JP); Shigeru Nakama, Hamamatsu (JP); Osamu Horiuchi, Hamamatsu (JP)

(73) Assignee: Nichias Co., Ltd., Tokyo (JP)

( * ) Notice: Subject to any disclaimer, the term of this patent is extended or adjusted under 35 U.S.C. 154(b) by 0 days.

(21) Appl. No.: 09/930,462

(22) Filed: Aug. 16, 2001

(65) Prior Publication Data

US 2002/0044804 A1 Apr. 18, 2002

(30) Foreign Application Priority Data

Aug. 28, 2000 (JP) ..... 2000-257626

(51) Int. Cl.[7] ..... G03G 15/20
(52) U.S. Cl. ..... 399/325; 118/258; 118/264
(58) Field of Search ..... 399/324, 325; 118/60, 258, 262, 264; 428/375, 391; 492/17, 18, 53

(56) References Cited

U.S. PATENT DOCUMENTS

| | | | | | |
|---|---|---|---|---|---|
| 4,757,347 | A | * | 7/1988 | Tamaoki et al. | 399/325 |
| 5,061,965 | A | * | 10/1991 | Ferguson et al. | 399/325 |
| 5,232,499 | A | * | 8/1993 | Kato et al. | 399/325 X |
| 5,267,004 | A | * | 11/1993 | Mills | 399/325 |
| 5,482,552 | A | * | 1/1996 | Kikukawa et al. | 399/325 X |
| 5,732,317 | A | * | 3/1998 | Orchard, II et al. | 399/325 |
| 5,853,832 | A | * | 12/1998 | Ishikawa | 399/325 |
| 6,029,040 | A | * | 2/2000 | Yamada et al. | 399/325 |

* cited by examiner

*Primary Examiner*—William J. Royer
(74) *Attorney, Agent, or Firm*—Oblon, Spivak, McClelland, Maier & Neustadt, P.C.

(57) ABSTRACT

An oil application device having an oil application amount control layer bonded to an oil retaining member for retaining application-use silicone oil using the mixture of adhesive and mixture-use silicone oil. The ratio $(V_{KS})/(V_{TS})$ of a viscosity $(V_{KS})$ of the mixture-use silicone oil at 25° C. to a viscosity $(V_{TS})$ of the application-use silicone oil at 25° C. ranges from 50/1 to 1/10. By using the oil application device, releasing oil can be applied to a thermal fixing roller uniformly. The oil application amount control layer does not peel off or is not displaced during operation, and no oil exudes during nonuse.

9 Claims, 1 Drawing Sheet

OIL APPLICATION DEVICE HAVING OIL APPLICATION AMOUNT CONTROL LAYER BONDED TO OIL RETAINING MEMBER FOR RETAINING APPLICATION-USE SILICONE OIL USING MIXTURE OF ADHESIVE AND MIXTURE-USE SILICONE OIL

TECHNICAL FIELD

The present invention relates to an oil application device as a component of a fixing device of an electrostatic process copying machine, an electrophotographic printer or the like.

BACKGROUND ART

In a fixing device of an electronic copying machine, an electronic printing machine or the like, during fixation of toner than has been transferred to a recording paper, the toner may adhere to a thermal fixing roller. To prevent the toner from soiling another recording paper, a very small amount of releasing oil such as silicone oil is applied to the thermal fixing roller using an oil application roller. Thus, toner is prevented from adhering to the thermal fixing roller, and recording papers are prevented from being stuck to one another and rolled up.

Various oil application rollers having such a function have already been proposed. For example, a cylindrical formed body made from a perforated metal hollow pipe and heat-resistant fiber is used as an oil retaining member for storing releasing oil to be applied, and an oil application amount control layer e.g. made from a polytetrafluoroethylene (PTFE) porous film is wound around the surface of the cylindrical formed body. Ends and wrapping portions of the oil application amount control layer are coated with RTV silicon rubber and bonded, so that an oil application roller is manufactured. Further, there is another oil application roller, which is manufactured by processing the oil application amount control layer as described above into a tube, covering a cylindrical oil retaining member with the tube, and heating and contracting them (see Japanese Patent Application Laid-Open No. HEI 9-185282).

Further, there is an application mechanism for copying machines, which is provided with an oil application amount control layer that has been formed through cross linkage after impregnation of voids of porous polytetrafluorethylene of the surface of a thick porous material as an oil retaining member with the mixture of silicon rubber and releasing oil (Japanese Published Patent No. HEI6-73051). That is, this application mechanism for copying machines is obtained by winding an oil application amount control layer around the surface of the thick porous material like a rolled layer, heating them at a high temperature for many hours to cause cross linkage, and thermally fusing them. This application mechanism for copying machines can suitably control releasing oil, i.e., silicone oil, and especially can stably control it over a long time even in an area where a very small amount of silicone oil is applied for oilless toner. Further, Japanese Patent Application Laid-Open No. 2000-79365 discloses an oil application device in which a felt layer is disposed on a surface of a cylindrical oil retaining member made from porous ceramics material and in which a PTFE porous film is disposed on the felt layer. This oil application device applies oil that has exuded to the felt from the oil retaining member, while controlling the oil by means of the porous film. Further, the oil application device may not necessarily be of a roller type. For example, there is known an oil application device in which oil is applied to a fixing roller by a generally flat pad.

However, in the above-mentioned oil application roller in which the oil application amount control layer is bonded with the cylindrical formed body, almost no releasing oil flows out of the bonded portion so that oil is applied unevenly, or the bonding strength is insufficient due to a small bonded area so that the oil application amount control layer is displaced or peels off. That is, it is difficult to always stably apply releasing oil to the thermal fixing roller. Further, in the oil application roller manufactured by heating and contracting the tubular oil application amount control layer, the oil application amount control layer tends to be heated and contracted inhomogeneously, and the pore diameter is inconsistent. That is, it is difficult to always stably apply releasing oil to the thermal fixing roller. Furthermore, in the application mechanism for copying machines, when the oil application amount control layer is thermally fused with the thick porous material, heating must be carried out for a long time at a high temperature. Thus, the process tends to be too troublesome. Further, in the application device that applies oil that has exuded to the felt from the oil retaining member while controlling the oil by means of the porous film or in the application device that applies oil to the fixing roller by means of a pad-like structure, the same problem as described above arises as to a method of bonding the oil application amount control layer to the top surface layer. Namely, also in this case, no releasing oil flows out of the bonded portion so that unevenness of application is caused, or the bonding strength is insufficient due to a small bonded area so that the oil application amount control layer is displaced or peels off. This leads to a problem of fluctuations of application amount of oil. Furthermore, in a so-called inoperative state other than application, e.g., in a state from shipment to preservation of products, it is also required that oil in the oil retaining member be prevented from exuding from the oil application amount control layer. Such exudation of oil causes a problem of excessive application of oil at the beginning of an application process when restarting the application device.

It is thus an object of the present invention to provide an oil application device in which releasing oil can be uniformly applied to a thermal fixing roller, in which an oil application amount control layer is not displaced or does not peel off during operation, and which can be bonded with an oil retaining member easily. It is another object of the present invention to provide an oil application device in which no oil exudes from an oil application amount control layer e.g. in a still-standing state from shipment to preservation of products.

DISCLOSURE OF THE INVENTION

Under such circumstances, the inventors discovered the following facts as a result of careful and detailed research and succeeded in completing the invention. That is, if an oil application amount control layer is bonded with an oil retaining member for retaining application-use silicone oil by means of the mixture of adhesive and mixture-use silicone oil, the mixture is in a state of dispersal of the adhesive and the mixture-use silicone oil. Thus, the oil application amount control layer is bonded with the oil retaining member due to the hardening of the adhesive. In the oil application amount control layer, closed-pore portions and unclosed-pore portions with interposition of the unhardened mixture-use silicone oil are dispersed through each other. This bonded portion in a state of dispersal prevents the oil application amount control layer from being displaced or peeling off, and the mixture-use silicone oil in its dispersed state serves as an oil passage and makes it possible to uniformly apply application-use silicone oil to a thermal fixing roller. If the ratio of the viscosity of application-use silicone oil to the viscosity of mixture-use silicone oil is in a certain range, i.e., if the viscosity of application-use silicone oil is relatively close to the viscosity of mixture-use silicone oil, no oil exudes from the oil application amount control layer in a still-standing state.

That is, the first invention of the present invention provides an oil application device wherein an oil application amount control layer is bonded with an oil retaining member for retaining application-use silicone oil, using the mixture of adhesive and mixture-use silicone oil, and wherein the ratio $(V_{KS})/(V_{TS})$ of a viscosity $(V_{KS})$ of the mixture-use silicone oil at 25° C. to a viscosity $(V_{TS})$ of the application-use silicone oil at 25° C. ranges from 50/1 to 1/10. According to this construction, the oil retaining member and the oil application amount control layer are bonded together while being dispersed as a whole due to the hardening of the dispersed adhesive, and the oil application amount control layer guarantees a passage for the application-use silicone oil while being dispersed as a whole due to the dispersed mixture-use silicone oil. Further, since diffusion (infiltration) of the application-use silicone oil into the mixture-use silicone oil existing as an oil passage is suppressed in a still-standing state, no silicone oil exudes to the surface of the oil application amount control layer.

Further, the second invention of the present invention provides an oil application device wherein an oil application amount control layer is bonded with an oil transfer layer that is provided on an oil-application side of an oil retaining member for retaining application-use silicone oil, using the mixture of adhesive and mixture-use silicone oil, and wherein the ratio $(V_{KS})/(V_{TS})$ of a viscosity $(V_{KS})$ of the mixture-use silicone oil at 25° C. to a viscosity $(V_{TS})$ of the application-use silicone oil at 25° C. ranges from 50/1 to 1/10. According to this construction, even in the case where the oil transfer layer for preventing uneven application is provided between the oil retaining member and the oil application amount control layer, the same effect as described above can substantially be achieved.

Further, the third invention of the present invention provides an oil application device wherein the viscosity $(V_{KS})$ of the mixture-use silicone oil at 25° C. is equal to the viscosity $(V_{TS})$ of the application-use silicone oil at 25° C. According to this construction, diffusion (infiltration) of the application-use silicone oil into the mixture-use silicone oil is further suppressed, not to mention that the same effect as described above can substantially be achieved during non-use. Therefore, it is possible to reliably prevent silicone oil from exuding to the surface of the oil application amount control layer.

DETAILED DESCRIPTION

Figure 1:
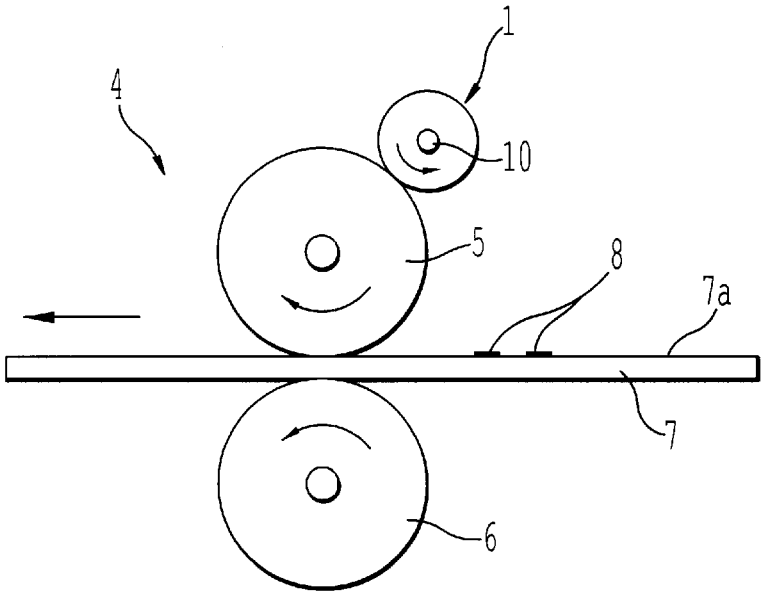
FIG. 1 is a side view showing how an oil application device according to an embodiment of the present invention is installed in a fixing device.
Figure 2:
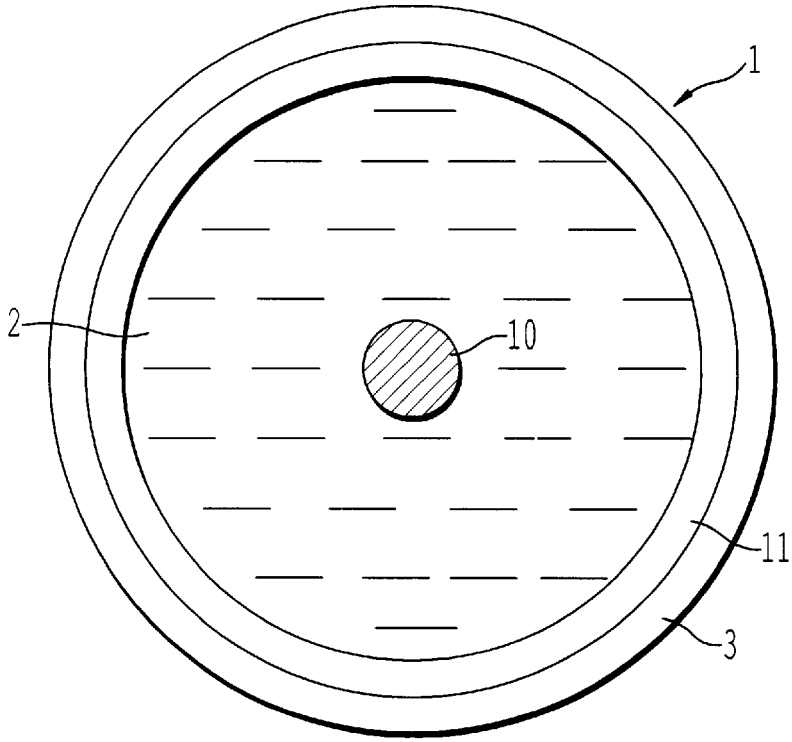
FIG. 2 is a radial cross-sectional view of the oil application device according to the embodiment of the present invention.

Hereinafter, an oil application device according to an embodiment of the present invention will be described in detail with reference to FIGS. 1 and 2. FIG. 1 is a side view showing how the oil application device according to the embodiment of the present invention is installed in a fixing device. FIG. 2 is a radial cross-sectional view of the oil application device according to the embodiment of the present invention. In the drawings, the oil application device is denoted by reference numeral 1. The oil application device 1 is basically composed of an oil retaining member 2 and an oil application amount control layer 3, which are bonded together by the mixture of adhesive and mixture-use silicone oil. The oil application device 1 is built into a fixing device 4, which allows a recording paper 7 to pass through a space between a thermal fixing roller 5 and a press roller 6 so that toner 8 transferred to a surface 7*a* of the recording paper 7 will be fixed. In order to prevent the toner 8 on the surface 7*a* of the recording paper 7 from adhering to the thermal fixing roller 5, the oil application device 1 is opposed to and in contact with the thermal fixing roller 5 so as to apply releasing oil, i.e., application-use silicone oil to the thermal fixing roller 5.

The oil retaining member 2 is not specifically limited as long as it has a structure capable of retaining application-use silicone oil. For instance, the oil retaining member 2 of this embodiment is a cylindrical porous formed body for retaining a large amount of application-use silicone oil in a large-capacity agglomerate of pores with a pore diameter of 50 to 2000 $\mu$m and a volume porosity of 60 to 80%. The oil retaining member 2 is fitted with a shaft 10. Due to capillarity, the retained application-use silicone oil is transferred to an oil transfer layer, i.e., a heat-resistant felt 11 via minute inter-fiber gaps, then infiltrates into the oil application amount control layer 3 made of a porous film, and finally exudes to the surface of the oil application amount control layer 3. The application-use silicon oil used in this embodiment has a low viscosity$(V_{TS})$, which is usually $10\times10^{-6}$ to $500\times10^{-6}$ $m^2$/seconds (10 to 500 cSt) and preferably $50\times10^{-6}$ to $300\times10^{-6}$ $m^2$/seconds (10 to 300 cSt) at a temperature of 25° C. Although the oil retaining member 2 is preferably a porous ceramic formed body, it should not be limited to the formed body of the above-mentioned structure. Namely, it is possible to use a great variety of porous materials including a spongy material, a material with a pore diameter of less than 50 $\mu$m. Because releasing oil is retained in the large pores and because the inter-fiber gaps allow the releasing oil to be transferred due to capillary action, the oil retaining member 2 can achieve high oil-retaining performance and age-resistant oil application performance.

A porous-ceramic oil retaining member can be manufactured as follows. That is, one or more ceramic fibers selected from silica fiber, silica alumina fiber, alumina fiber and glass fiber, one or more kinds of ceramic particles that are selected from silica particles, silica alumina particles, alumina particles and glass articles and that are blended if necessary, one or more inorganic binders selected from silica sol, alumina sol and glass frit, particles of organic resins such as polypropylene, an organic binder, and water are used as raw materials. These kneaded raw materials are formed into a formed body of a predetermined shape e.g. by extrusion. Then, the formed body is dried and calcined to obtain the porous-ceramic oil retaining member 2. The ceramic fibers to be selected have a fiber diameter of 2 to 30 $\mu$m and a fiber length of 100 to 5000 $\mu$m. The ceramic particles to be selected have a particle diameter of 10 to 50 $\mu$m. The organic resin particles to be used have a particle diameter of 200 to 2000 $\mu$m.

The above porous ceramic material is provided with a porous structure through gasification of organic binder, water and organic resin particles at the time of calcination.

More specifically, inter-fiber gaps with a main pore diameter of 10 to 100 μm are formed through gasification of organic binder and water, and large pores with a diameter of 200 to 2000 μm are obtained through gasification of organic resin particles. In this porous ceramic material, the large pores serve to store up silicone oil and the inter-fiber gaps serve to transfer silicone oil by means of capillarity.

An oil transfer layer 11 is formed on an outer periphery of the oil retaining member 2. The oil transfer layer 11 can be made from a heat-resistant fiber felt. For example, this heat-resistant fiber felt is obtained by forming a group of fiber materials into a sheet web by roller forming or the like and then processing it by needle punching. The heat-resistant fiber felt is composed of a fiber material with a diameter of approximately 10 μm and has a three-dimensional flexible network structure with a weight of 200 to 800 g/m$^2$, a thickness of 1 to 5 mm, and a density of 170 to 260 kg/m$^3$. The oil transfer layer 11 may be a lamination of different kinds of layers. By disposing the oil transfer layer 11 on the outer periphery of the oil retaining member 2, the oil application device 1 can ensure a certain contact area in supplying releasing oil while being in contact with the fixing roller 5 and guarantee uniform application of a predetermined amount of releasing oil. A method of disposing the oil transfer layer 11 on the oil retaining member 2 is not specifically limited. For example, it is possible to adopt a method of winding a felt around the oil retaining member 2 and fixing it thereto e.g. by means of adhesives or pressure fittings, a method of carrying out fixation based on adhesion to a later-described PTFE film, and so on. According to one example of such methods, RTV rubber is applied to the edges of a felt that has been cut into the shape of a ribbon with a width of approximately 30 mm, and the felt is brought into abutment on the oil retaining member 2 with the edges not overlapping with one another, and is spirally wound around the oil retaining member 2.

The oil application amount control layer 3 has a gas permeability of 10 to 2000 seconds/100 cc and is not specifically limited as long as silicone oil can permeate therethrough. A stretched polytetrafluoroethylene (PTFE) porous film (hereinafter referred to as the PTFE porous film) is used as the oil application amount control layer 3 of this embodiment. For example, the PTFE porous film has a surface roughness Ra of 0.7 to 0.8 mm, thickness of 50 to 100 μm, a gas permeability of 60 to 100 seconds/100 cc, an open pore diameter of 0.05 to 2.0 μm and an open porosity of 70 to 90 %. Note that the "gas permeability" is a Gurley's number (unit: seconds/100 cc) measured by a B-type Gurley densometer and that the "open porosity" is calculated from measured specific gravities according to the following equation: open porosity (%)=(1−bulk specific gravity/absolute specific gravity)×100.

The oil application amount control layer 3 is bonded with the oil transfer layer 11 formed on the outer periphery of the oil retaining member 2 using th e mixture of adhesive and mixture-use silicone oil. It is important that adhesive and mixture-use silicone oil be mixed sufficiently and dispersed through each other in the mixture. Although bonding may occur either partially or entirely, entire bonding is preferred because it can enhance bonding strength of the oil application amount control layer 3 and thus achieve higher reliability. For example, in the case of entire bonding, the mixture is applied to the back (bonded surface) of the oil application amount control layer 3 with a density of 50 to 250 g/m$^2$, and the back of the oil application amount control layer 3 is stuck to the oil transfer layer 11 and then dried for one to four hours until the adhesive components are solidified. Thus, since the solidified adhesive components exist in some of the open pores while being dispersed into mixture-use silicone oil, strength and durability of the porous film can further be enhanced. On the other hand, from a microscopic point of view, since adhesive is dispersed into mixture-use silicone oil in the mixture of adhesive and mixture-use silicone oil, the area of silicone oil serves as a passage for releasing oil in the open pores. Accordingly, the open pores of the porous film are filled with the mixture, whereby a passage for releasing oil is guaranteed despite closure of the open pores. Thus, a suitable amount of releasing oil can be applied, and the amount of application can be controlled.

The adhesive is not specifically limited as long as it can bond the oil transfer layer 11 with the oil application amount control layer 3 in the presence of mixture-use silicone oil. For example, silicon varnish is used as the adhesive. What is generally called silicon varnish can be used as silicon varnish. For example, silicon resin is obtained by excessively increasing a cross-link density of silicon rubber, and silicon varnish is obtained by dissolving unreacted silicon resin into a solvent. This silicon varnish has many 3- to 4-functional components and is superior in bonding performance to silicon rubber. Silicon varnish has a viscosity of $10\times10^{-6}$ to $200000\times10^{-6}$ m$^2$/seconds (10 to 200000 cSt) at a temperature of 25° C., and preferably of $500\times10^{-6}$ to $100000\times10^{-6}$ m$^2$/seconds (500 to 100000 cSt) at a temperature of 25° C. Note that the term "viscosity" in the present specification means viscosity at a temperature of 25° C. unless otherwise specified.

Concrete examples of mixture-use silicone oil, which is to be mixed with silicon varnish, include straight-chain methyl silicone oil, bifurcated methyl silicone oil, methyl phenyl silicone oil and modified silicone oil that has some of its dimethyl groups replaced by other organic groups. The mixture-use silicone oil usually has a viscosity ($V_{KS}$) of $1\times10^{-6}$ to $25000\times10^{-6}$ m$^2$/seconds (1 to 25000 cSt), and preferably of $(50)\times10^{-6}$ to $(3000)\times10^{-6}$ m$^2$/seconds (50 to 3000 cSt), more preferably of $(50)\times10^{-6}$ to $(300)\times10^{-6}$ m$^2$/seconds (50 to 300 cSt).

In the present invention, the ratio $(V_{KS})/(V_{TS})$ of the viscosity of mixture-use silicone oil ($V_{KS}$) to the viscosity of application-use silicone oil ($V_{TS}$) ranges from 50/1 to 1/10, and preferably ranges from 5/1 to 1/2, and most preferably is equal to 1/1. If the viscosity ($V_{KS}$) of mixture-use silicone oil is fifty or more times a high as the viscosity ($V_{TS}$) of application-use silicone oil, i.e., has too high a degree of polymerization, low-viscosity application-use silicone oil is diffused (infiltrated) into high-viscosity mixture-use silicone oil via a porous member such as the oil retaining member or in the porous member. In addition, due to a capillarity-based moving force applied from the oil retaining member to the PTFE film in the felt layer, the concentration of silicone oil (the mixture of application-use silicone oil and mixture-use silicone oil) is increased in the vicinity of an interface between the felt layer and the PTFE film. As a result, in a still-standing state, part of the silicone oil exudes to the surface of the PTFE film. However, if the viscosity of mixture-use silicone oil and the viscosity of application-use silicone oil satisfy the above-mentioned relationship, the phenomenon of diffusion of application-use silicone oil into mixture-use silicone oil is suppressed. Thus, in a still-standing state, no silicone oil exudes to the surface of the PTFE film.

The mixture ratio (SW:SO) of silicon varnish (SW) to mixture-use silicone oil (SO) ranges from 10:90 to 90:10. If the amount of silicon varnish is too large, the adhesive area is large and the passage for silicone oil is narrow, which results in an insufficient amount of application. On the contrary, if the amount of mixture-use silicone oil is too large, the adhesive area is small and the bonding strength, especially the initial bonding strength between the oil transfer layer 11 and the oil application amount control layer 3 is insufficient. Further, the mixture of silicon varnish and mixture-use silicone oil has a viscosity of e.g. $100\times10^{-6}$ to $180000\times10^{-6}$ $m^2$seconds (100 to 180000 cSt), and preferably of $200\times10^{-6}$ to $5000\times10^{-6}$ $m^2$/seconds (200 to 50000 cSt). If the viscosity of the mixture is too low, the initial bonding strength in bonding the oil application amount control layer 3 with the oil transfer layer 11 is small. As a result, immediately after application of the mixture to the oil application amount control layer 3, the mixture flows out of the open pores in the oil application amount control layer 3. On the other hand, if the viscosity of the mixture is too high, the open pores in the oil application amount control layer 3 is unlikely to be filled with the mixture, and it is difficult to achieve a sufficient bonding strength.

In the present invention, although either the oil retaining member and the oil application amount control layer or the oil transfer layer and the oil application amount control layer are bonded together by the above-mentioned mixture, the adhesive layer may or may not manifest itself. For example, the PTFE film and the felt layer are bonded together, and as a result of infiltration of the above-mentioned mixture into the PTFE film and the felt layer, an adhesive-coated layer irrelevant to bonding may be formed.

Although the roller-type oil application device has been described as an example of this embodiment, the present invention is not limited thereto. The present invention is widely applicable to oil application devices for applying releasing oil while being in contact with a member to which oil is to be applied, e.g., planar or linear oil application devices. The oil application device of the present invention applies a very small amount of releasing oil such as silicone oil to a thermal fixing roller of an electronic copying machine, an electronic printing machine or the like, and thus can prevent toner from adhering to the thermal fixing roller.

EXAMPLES

Next, the present invention will be described in more detail referring to examples, which are not intended to limit the present invention.

Example 1

50 parts by weight of silica alumina fiber with a fiber diameter of 5$\mu$m and a fiber length of 2500 $\mu$m, 20 parts by weight of polyethylene resin powders with a particle diameter of 300 $\mu$m, 10 parts by weight of silica sol, 10 parts by weight of methyl cellulose as an organic binder, and 50 parts by weight of water were kneaded. By extruding these kneaded materials, a cylindrical formed body with a length of 300 mm and a diameter of 33 mm was obtained. Next, this cylindrical formed body was dried for two hours at 120° C. and then calcined for eight hours at 480° C. Inter-fiber gaps with a main diameter distribution of 10 to 100 $\mu$m were formed through gasification of water and the organic binder in this process. Further, a porous-ceramic oil retaining member having large pores with a diameter of 300 $\mu$m was obtained through burnout of resin particles. Next, an oil transfer layer was provided on an application side of the porous-ceramic oil retaining member. The oil transfer layer was fixed to the oil retaining member by applying RTV silicon rubber to edges of a heat-resistant fiber felt in the shape of a ribbon with a thickness of 2 mm, a weight of 500 g/$m^2$ and a width of 30 mm, and spirally winding the felt around the oil retaining member with the adjacent edges abutting on each other.

Then, a PTFE porous film as the oil application amount control layer was provided on an application side of the oil transfer layer. The PTFE porous film was bonded using the mixture obtained by mixing silicone oil (manufactured by Shinetsu Chemical Industry Corporation: KF-96-100) with a viscosity of $100\times10^{-6}$ $m^2$/seconds (100 cSt) with silicon varnish (manufactured by Shinetsu Chemical Industry Corporation: KR-105) with a viscosity of $700\times10^{-6}$ $m^2$/seconds (700 cSt) at a ratio of 20:80 (weight ratio). The viscosity of the mixture was approximately $450\times10^{-6}$ $m^2$/seconds (450 cSt). The bonding of the PTFE porous film was carried out by adding 3 weight percent of a catalytic hardener to silicon varnish, applying the above-mentioned mixture to the PTFE porous film with a surface density of 120 g/$m^2$, and winding the PTFE porous film around the surface of the heat-resistant fiber felt. After winding the PTFE porous film around the surface of the heat-resistant fiber felt, they were dried for three hours and then heated for five hours a 170° C. so as to promote hardening of the silicon varnish so that the silicon varnish components were solidified. Then, in a pressure-reducing container, the porous-ceramic oil retaining member was impregnated with releasing oil, i.e., application-use silicone oil. In this example, application-use silicone oil is materially identical with the mixture-use silicone oil which was mixed with the silicon varnish. The oil application device thus obtained was put through an oil exudation test shown below and evaluated. The result is shown in Chart 1.

(Oil Exudation Test)

A brand-new oil application device retaining application-use silicone oil is left in a still-standing state for ten days at a room temperature, and the degree of exudation of silicone oil to the surface of the PTFE film was observed. Criteria for evaluation are as follows and indicate sweating degrees of oil.

"x" . . . Oil has remarkably exuded.

"Δ" . . . Oil has slightly exuded.

"O" . . . No oil has exuded.

Example 2

Instead of mixture-use silicone oil (manufactured by Shinetsu Chemical Industry Corporation: KF-96-100) with a viscosity of $100\times10^{-6}$ $m^2$/seconds (100 cSt), mixture-use silicone oil (manufactured by Shinetsu Chemical Industry Corporation: KF-96-500) with a viscosity of $500\times10^{-6}$ $m^2$/seconds (500 cSt) was used. Silicone oil (manufactured by Shinetsu Chemical Industry Corporation: KF-96-100) with a viscosity of $100\times10^{-6}$ $m^2$/seconds (100 cSt) was used as application-use silicone oil. In other respects, the test was conducted in the same manner as in Example 1. The result is shown in Chart 1.

Example 3

Instead of mixture-use silicone oil (manufactured by Shinetsu Chemical Industry Corporation: KF-96-100) with a viscosity of $100\times10^{-6}$ $m^2$/seconds (100 cSt), mixture-use silicone oil (manufactured by Shinetsu Chemical Industry Corporation: KF-96-1000) with a viscosity of $1000\times10^{-6}$ $m^2$/seconds (1000 cSt) was used. Silicone oil (manufactured by Shinetsu Chemical Industry Corporation: KF-96- 00) with a viscosity of $100\times10^{-6}$ $m^2$/seconds (100 cSt) was used as application-use silicone oil. In other respects, the test as conducted in the same manner as in Example 1. The result is shown in Chart 1.

Example 4

Instead of mixture-use silicone oil (manufactured by Shinetsu Chemical Industry Corporation: KF-96-100) with a viscosity of $100\times10^{-6}$ $m^2$/seconds (100 cSt), mixture-use silicone oil (manufactured by Shinetsu Chemical Industry Corporation: KF-96-5000) with a viscosity of $5000\times10^{-6}$ $m^2$/seconds (5000 cSt) was used. Silicone oil (manufactured by Shinetsu Chemical Industry Corporation: KF-96- 100) with a viscosity of $100\times10^{-6}$ $m^2$/seconds (100 cSt) was used as application-use silicone oil. In other respects, the test was conducted in the same manner as in Example 1. The result is shown in Chart 1.

Comparative Example 1

Instead of mixture-use silicone oil (manufactured by Shinetsu Chemical Industry Corporation: KF-96-100) with a viscosity of $100\times10^{-6}$ $m^2$/second (100 cSt), mixture-use silicone oil (manufactured by Shinetsu Chemical Industry Corporation: KF-96H-10000) with a viscosity of $10000\times10^{-6}$ $m^2$/seconds (10000 cSt) was used. Silicone oil (manufactured by Shinetsu Chemical Industry Corporation: KF-96-100) with a viscosity of $100\times10^{-6}$ $m^2$/seconds (100 cSt) as used as application-use silicone oil. In other respects, the test was conducted in the same manner as in Example 1. The result is shown in Chart 1.

Chart 1

| | $(V_{KS})/(V_{TS})$ | Sweating degree of oil |
|---|---|---|
| Example 1 | 1 | ○ |
| Example 2 | 5 | ○ |
| Example 3 | 10 | ○ |
| Example 4 | 50 | ○/Δ |
| Comparative Example 1 | 100 | X |

As is apparent from Chart 1, the sweating degree of oil in Comparative Example 1 is undesirable. This is because of the following reason. Mixture-use silicone oil that was mixed with silicon varnish has a much higher viscosity (i.e., a much higher degree of polymerization) than application-use silicone oil. Thus, in an inoperative state, application-use silicone oil is diffused to a area close to the interface between the felt layer and the PTFE film, i.e., an area where the mixture exists. As a result, the concentration of silicone oil in the vicinity of the area is increased, and part of the silicone oil is extruded to the surface of the PTFE film due to the increase in concentration. Further, in Examples 1 to 4, mixture-use silicone oil that was mixed with silicon varnish is close in viscosity (i.e., substantially equal in degree of polymerization) to application-use silicone oil. Thus, in an inoperative state, application-use silicone oil is not diffused to an area close to the interface between the felt layer and the PTFE film, i.e., an area where the mixture exists. Thus, oil is not exuded to the surface of the PTFE film. Although slight exudation of oil was observed in Example 4, it was at a negligible level. Accordingly, the ratio of viscosity $(V_{KS})/(V_{TS})$ has a critical point of 50.

Further, the oil application devices of Examples 1 to 4 were fitted to a commercial color printer (with a color-paper feeding speed of 4 ppm), and 5000 sheets of normal color paper were passed therethrough. Then, the amount of silicone oil applied to each of the sheets was measured. Furthermore, it was checked by the eye whether the PTFE film peeled off or was displaced. As a result, the application amount of silicone oil stabilized in a range of 1.5 to 2.0 mg/A4, and no peeling or displacement of the PTFE film was observed.

INDUSTRIAL APPLICATION

According to the first invention of the present invention, due to the hardening of the adhesive in its dispersed state, the oil retaining member and the oil application amount control layer are bonded together while being dispersed as a whole. Due to the mixture-use silicone oil in its dispersed state, the oil application amount control layer guarantees a flow passage for silicone oil while being dispersed as a whole. Thus, application-use oil, i.e., silicone oil can be applied to the thermal fixing roller uniformly, and the oil application amount control layer does not peel off or is not displaced during operation. Moreover, the oil application amount control layer can be easily bonded with the oil retaining member. Furthermore, during nonuse, silicone oil can be prevented from exuding from the surface of the oil application device.

According to the second invention of the present invention, the oil transfer layer is provided between the oil retaining member and the oil application amount control layer. Thus, as described above, the oil application amount control layer does not peel off or is not displaced during operation, and unevenness of application can be prevented more reliably. According to the third invention of the present invention, during nonuse, diffusion (infiltration) of application-use silicone oil into mixture-use silicone oil is further suppressed. Thus, silicone oil can be reliably prevented from exuding to the surface of the oil application amount control layer.

What is claimed as new and desired to be secured by letters patent of the United States is:

1. An oil application device comprising:

an oil application amount control layer;

an oil retaining member bonded to the oil application amount control layer, for retaining application-use silicone oil;

a bonding mixture of adhesive and mixture-use silicone oil bonding the oil application amount control layer to the oil retaining member; and a ratio $(V_{KS})/(V_{TS})$ of a viscosity $(V_{KS})$ of the mixture-use silicone oil at 25° C. to a viscosity $(V_{TS})$ of the application-use silicone oil at 25° C. ranges from 50/1 to 1/10.

2. An oil application device comprising:

an oil application amount control layer;

an oil transfer layer bonded to said oil application amount control layer, said oil transfer layer provided on an oil-application side of an oil retaining member for retaining application-use silicone oil;

a bonding mixture of adhesive and mixture-use silicone oil bonding the oil application amount control layer to the oil transfer layer; and a ratio $(V_{KS})/(V_{TS})$ of a viscosity $(V_{KS})$ of the mixture-use silicone oil at 25° C. to a viscosity $(V_{TS})$ of the application-use silicone oil at 25° C. ranges from 50/1 to 1/10.

3. The oil application device according to claim 1 or 2, wherein the ratio $(V_{KS})/(V_{TS})$ ranges from 5/1 to 1/2.

4. The oil application device according to claim 1 or 2, wherein the oil retaining member is a porous ceramic body.

5. The oil application device according to claim 1 or 2, wherein the oil application amount control layer is an extended polytetrafluoroethylene porous film.

6. The oil application device according to claim 1 or 2, wherein the adhesive is silicon varnish (SW), and a mixture ratio of the silicon varnish (SW) to the mixture-use silicone oil (SO) ranges from 10:90 to 90:10.

7. The oil application device according to claim 2, wherein the oil transfer layer is a heat-resistant felt.

8. The oil application device according to claim 1 or 2, wherein the viscosity $(V_{KS})$ of the mixture-use silicone oil at 25° C. is equal to the viscosity $(V_{TS})$ of the application-use silicone oil at 25° C.

9. The oil application device according to claim 1 or 2, wherein the oil application device is employed in an electronic copying machine or an electronic printing machine.

* * * * *